US005768862A

United States Patent [19]

Mauro

[11] Patent Number: 5,768,862

[45] Date of Patent: Jun. 23, 1998

[54] APPARATUS FOR THE WRAPPING OF PALLETIZED PRODUCT GROUPS WITH PLASTIC FILM

[75] Inventor: Ceré Mauro, Loiano (Bologna), Italy

[73] Assignee: Robopac Sistemi S.r.l., Rimini, Italy

[21] Appl. No.: 643,510

[22] Filed: May 6, 1996

[51] Int. Cl.[6] ..... B65B 53/00

[52] U.S. Cl. ..... 53/556; 53/588

[58] Field of Search ..... 53/588, 556, 210

[56] References Cited

U.S. PATENT DOCUMENTS

| | | | |
|---|---|---|---|
| 4,829,753 | 5/1989 | Bricmont | 53/588 |
| 4,905,448 | 3/1990 | Plitt | 53/588 X |
| 5,390,476 | 2/1995 | Morantz | 53/588 X |

FOREIGN PATENT DOCUMENTS

| | | | |
|---|---|---|---|
| 34 33 442 | 12/1985 | Germany . | |
| 36 34 924 | 4/1988 | Germany . | |
| 42 34 604 | 4/1994 | Germany . | |
| 4234604 | 4/1994 | Germany | 53/588 |

*Primary Examiner*—Linda Johnson
*Attorney, Agent, or Firm*—Fay, Sharpe, Beall, Fagan, Minnich & McKee

[57] ABSTRACT

The apparatus for the wrapping of palletized product groups with a film or band of plastic includes a framework with two vertical support uprights on a support structure of a carriage supporting a reel of plastic film and a pre-stretching unit driven by an electric motor and envisages that the support structure consists of a vertically moving structure supported by the support framework and by a rotating ring supported by the vertically moving structure and rotating around its own axis driven by a motor anchored to the vertically moving structure and connected to it; the carriage is fixed to the rotating ring and supports an electric generator for powering the electric motor of the pre-stretching unit and maintained with its own shaft continuously linked to a respective annular toothed track fixed to the vertically moving structure.

13 Claims, 2 Drawing Sheets

APPARATUS FOR THE WRAPPING OF PALLETIZED PRODUCT GROUPS WITH PLASTIC FILM

BACKGROUND OF THE INVENTION

The present invention relates to an apparatus for the wrapping of palletized products with plastic film.

There are many well-known apparatuses of this kind which consist of a support framework, usually gantry-shaped, and a reel carriage supported by a structure which itself is supported by the support framework. The support framework is usually located at a roller or belt conveyor or a similar apparatus for feeding the products to be wrapped, normally already placed on a pallet.

The reel carriage supports a reel of stretch plastic in band form and, usually, an unreeling and pre-stretching unit for the band material on the reel. The pre-stretching unit consists of one or more rollers revolving on their axes and driven by an electric motor supported by the carriage itself. The band material is then unreeled and wrapped on the power-driven rollers of the pre-stretching unit before being wrapped on the products.

With regard to the support structure, there are, in effect, two different embodiments: one fitted with an upside-down "L" arm and the other with a ring. Both can move the carriage along a circular or helical trajectory on a vertical axis which coincides substantially with the vertical axis of the products to be wrapped supported by the pallet. In this way, the reel rotates around the products to be wrapped and, depending on the requirements and the size of the task, it can be made to rise and fall along the vertical axis of the products themselves in order to wrap them with more turns of band. Usually, during the wrapping of the products, the band is "stretched" by the pre-stretching unit or it is extended both to economise the amount of band used and to increase its tension to allow greater cohesion to the products, especially if they form considerably high stacks.

The upside-down "L" arm type support structure consists of a horizontal and a vertical prong. The horizontal prong is supported by the framework above the conveyor and rotates around a vertical axis which coincides substantially with the vertical axis of the products to be wrapped. The vertical prong, on the other hand, forms a support and guide structure for the reel carriage which can be moved up and down on the vertical prong synchronised with the rotation of the horizontal prong. The horizontal prong is rotated by an electric motor connected to the support framework. The reel carriage is moved by an electric motor connected to the vertical prong and powered by sliding contact connections on the rotating support of the horizontal prong. Using the same sliding contact connections, power is transferred to the electric motor which is part of the pre-stretching unit.

The ring type support structure uses a ring supported by the support framework and is moved along it up and down. The ring supports the reel carriage and acts as a circular guide for it. The movement of the ring up and down is driven by electric motors powered up by electric cables which are easily protected since the movement of the ring up and down is straight-lined. The reel carriage, on the other hand, is driven by an electric motor mounted by it. Both the electric motor for moving the carriage and the electric motor for operating the pre-stretching unit are powered by sliding contact connections on the support and guide ring. The ring type support structure offers advantages in comparison with the other since it allows the wrapping of the products to start at almost any point of the products themselves. The fixing of the leading edge of the band can, in fact, be carried out at almost any height since the parts for cutting and holding the leading edge of the band can be supported by the ring itself. On the other hand, in the upside-down "L" arm type support structure, the same parts can only work in a fixed position, or one whose height can only be slightly adjusted, usually at the base of the products. Another advantage of the ring type support structure becomes clear when the products must have an upper cover. In the upside-down "L" arm type support structure, it is necessary to stop the arm in a pre-set position to allow an apparatus to move inside the support framework and to provide this cover. In the ring type support structure, on the other hand, it is sufficient to lower the ring and make it wrap the tape around the base of the products to allow free access to the top of the products. It is therefore clear that the ring type support structure can continue operating even during the phase of applying an upper cover to the products to be wrapped.

The ring type support structure, however, has various drawbacks which limit its field of application and which are all due to the presence of the sliding contact connectors which transmit the electrical supply to the electric motors supported by the reel carriage.

The use of these sliding contact connections, in fact, prevents the use of high efficiency protections and prevents the installation of the apparatus in environments which have high humidity. Moreover, the sliding contacts are subject to major wear and do not allow a high operating speed, thereby limiting the productivity of the apparatus itself.

SUMMARY OF THE INVENTION

The object of the present invention is therefore to provide an apparatus for wrapping palletized products which has the advantages of the ring type support structure but is without the drawbacks mentioned above.

BRIEF DESCRIPTION OF THE DRAWINGS

The technical characteristics of the invention, according to the above-mentioned objects, are clearly described in the Claims below and its advantages will become clear in the detailed description which follows, made with reference to the accompanying drawings, which represent an embodiment which is purely illustrative and is not binding, in which:

DESCRIPTION OF THE PREFERRED EMBODIMENTS

Figure 1:
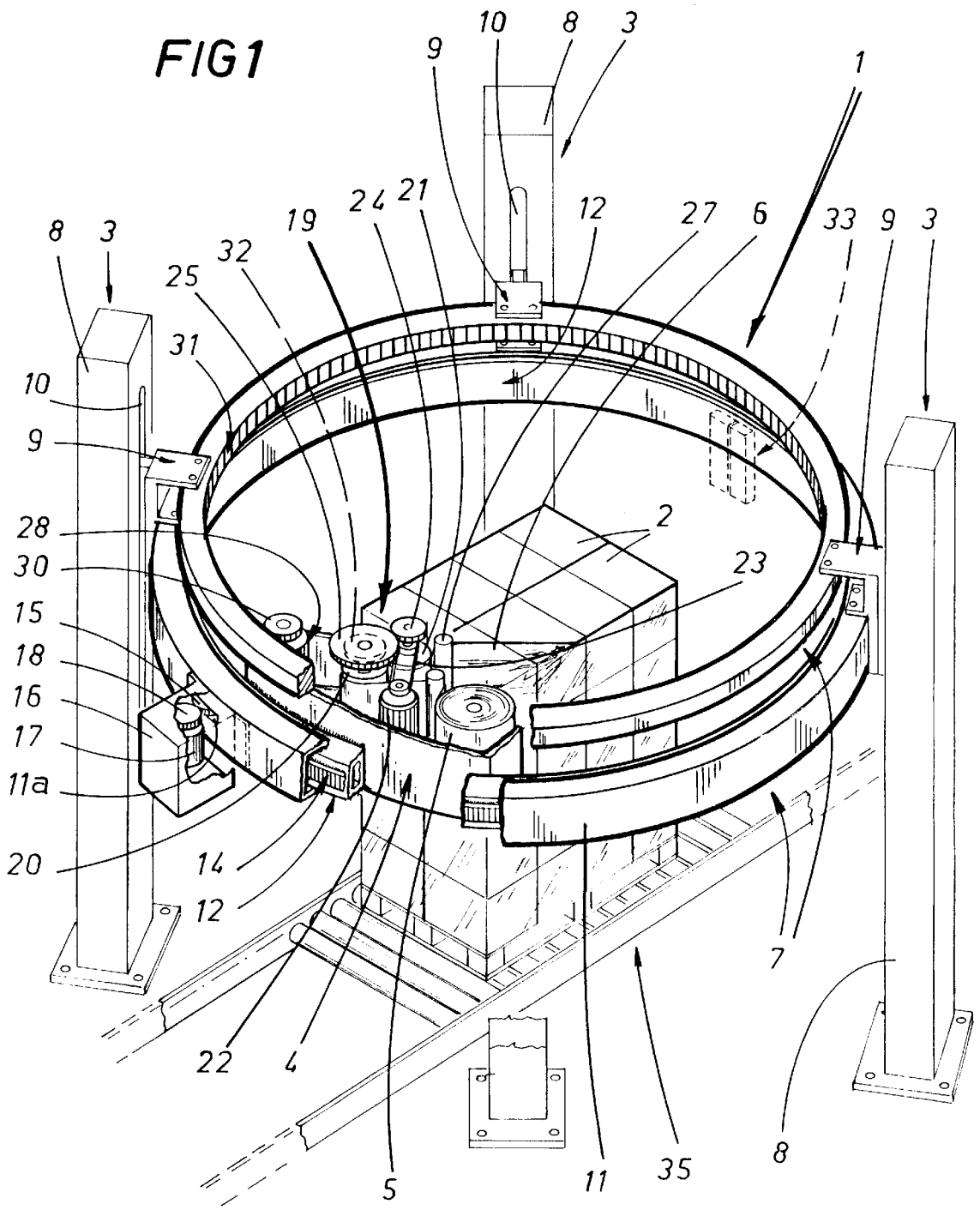
FIG. 1 is a schematic perspective view of the wrapping apparatus according to the present invention.

With reference to the accompanying drawings, the entire apparatus according to the present invention for the wrapping of palletized product groups 2 with a plastic film or band 6 is labeled 1 and consists of a support framework 3 for a support structure 7 of a reel 5 carriage 4 for stretch plastic material in band 6 form.

With reference to FIG. 1, it can be seen that the support framework 3 consists of a pair of vertical uprights 8 which can be fixed to the floor in the area in which the wrapping of the products 2 is to be carried out, for example, on opposing sides of a conveyor 35 for the transport and movement of the palletized products 2 (illustrated schematically as a single parallelepiped) to be wrapped with the band 6. Each upright 8 forms a support guide for a carriage 9 supported by well-known means, for example, a pair of power-driven chains 36, placed inside the upright 8 (See FIG. 3). In FIG. 1, one of the uprights 8 has a longitudinal slot 10 along which the carriage 9 moves.

The carriages 9 support the structure 7 which consists of a structure 11 fixed to the carriages 9 in a way which allows it to be moved up and down and by a rotating ring 12 supported by the structure 11 which is movable and rotating with respect to it. In the embodiment illustrated, the vertically moving structure 11 is also ring-shaped and has a rotating ring 12. Hereafter, for the sake of clarity, the vertically moving structure 11 will be simply referred to as the outer ring.

Figure 3:
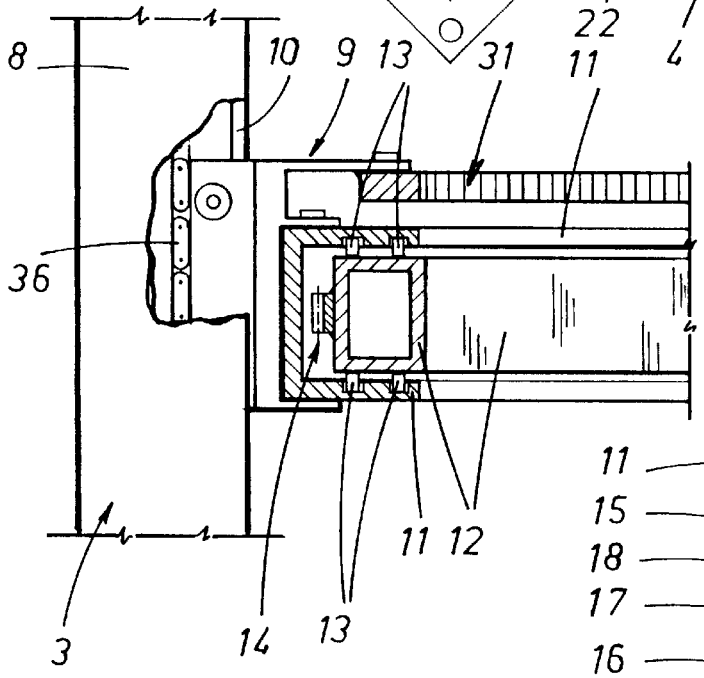
FIGS. 3 and 4 illustrate, in cross section, two details of one embodiment of a ring type support structure which is part of the apparatus in FIG. 1, namely, the sections of the support structure where the reel carriage is and where there is an electric operating motor which drives the rotating ring which is part of the support structure.
Figure 4:
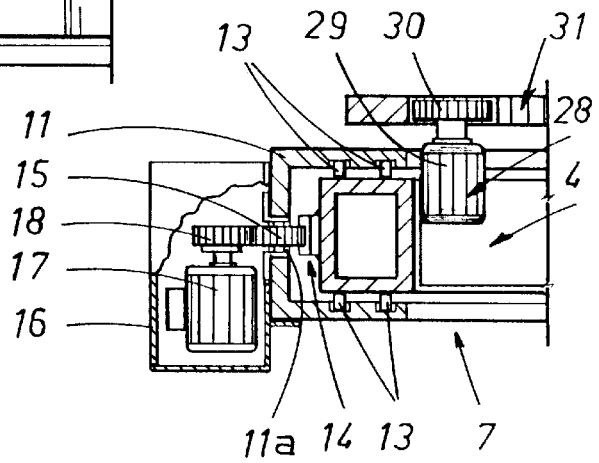

With reference to FIGS. 3 and 4, the outer ring 11 has a "C" shaped cross section and the rotating ring 12 has a complementary cross section, for example, a quadrilateral shaped hollow. The sides of the rotating ring 12, opposite the corresponding sides of the outer ring 11 are fitted with idle wheels 13 which facilitate the movement of the rotating ring 12. The rotating ring 12 has, at its outer side, a toothed section 14 which is kept engaged by an idle gear 15 mounted by the outer ring 11. The outer ring 11 also supports, using an upside-down "L" bracket, an electric motor 17 on whose shaft a pinion 18 is keyed, kept engaged by the idle gear 15. Therefore the electric motor 17 can only be moved up and down after the movement of the outer ring 11 and is powered by a power supply cable not illustrated as it is of a well-known type. As illustrated in FIGS. 1 and 4, the outer ring 11 is fitted with a slot 11a through which the idle gear 15 works to transmit motion from the motor 17 to the rotating ring 12.

The outer ring 11 also supports gripper and cutting means 33 for the band 6. The gripper and cutting means 33, which are not further described, are designed to cut the band 6 when the group of products 2 has been wrapped and to hold the free end just cut while the next group of products 2 is being wrapped.

Figure 2:
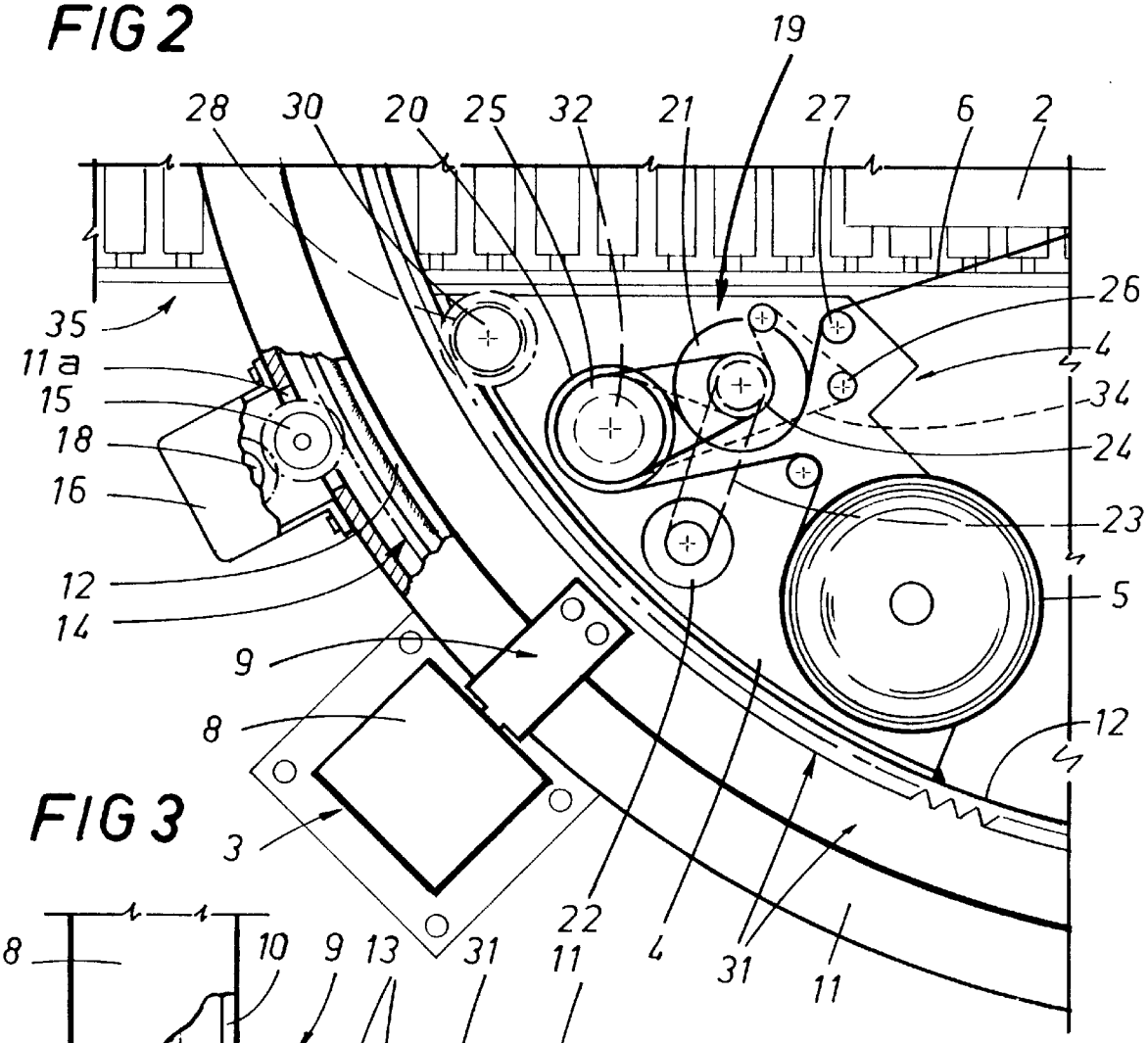
FIG. 2 is a schematic plan view of a pre-stretching unit which is part of the apparatus in FIG. 1 and fitted with a toothed belt drive rather than a pinion and toothed gear drive, as illustrated in FIG. 1.

The carriage 4 is anchored or fixed to the rotating ring 12. The carriage 4 supports a reel 5 of plastic band 6 and a pre-stretching unit 19 for the band 6. In the embodiment illustrated schematically in FIGS. 1 and 4, the pre-stretching unit 19 consists of a pair of rollers 20 and 21 power-driven by an electric motor 22 supported by and anchored to the carriage 4. The rollers 20 and 21 are rotated by the electric motor 22 at different speeds. With reference to FIG. 2, the roller 21 is connected to the electric motor 22 with a constant gear ratio using a toothed belt 23 while the roller 20 is connected to the roller 21 through a pinion 24 keyed to the roller 21 shaft and a toothed gear 25 keyed to the roller 20 shaft. The pinion 24 and the toothed gear 25 are connected to each other directly (See FIG. 1) or through a toothed belt 34 also around the idle return rollers 26 (See FIG. 2) and their gear ratio is such that the roller 20 turns much more slowly than the roller 21. The band 6 is first moved around the slow roller 20 then around the fast roller 21 so that, the greater the difference between the rollers 21 and 22, the greater the drive force between them. FIG. 2 also illustrates an idle roller 27, the so-called "dandy roller" on which the band 6 is wrapped before it is fed to the products 2 on which it is to be wrapped.

The electric motor 22 which drives the pre-stretching unit 19 is powered by a power generator 28 whose shaft is connected continuously to the outer ring 11. The generator 28 consists of an alternator 29 on whose shaft a pinion 30 is keyed and kept engaged to an annular toothed track 31 connected to the outer ring 11 as illustrated in FIGS. 1 and 2. In this way, during the rotation of the rotating ring 12, the alternator 29 generates electric energy sufficient to allow the electric motor 22 of the pre-stretching unit 19 to function correctly.

With reference to FIGS. 1 and 2, there is an electro-magnetic clutch 32 placed between the slow roller 20 and the relative toothed gear 25. It is de-energised or put in a configuration where it does not transmit motion when the rotating ring 12 stops. In this way, when the rotating ring 12 starts up, the slow roller 20 is disconnected from the electric motor 22 while the fast roller 21 stays connected to the same electric motor 22. The fast roller 21 disconnected from the slow roller 20 can therefore turn freely and rotate the electric motor 22 when it is not powered, as will be described below. To further facilitate the movement of the fast roller 21, there may be a second electro-magnetic clutch not illustrated and placed between the fast roller 21 shaft and the relative pinion 24. This second clutch would allow the complete isolation, at least from the point of view of kinematic connections, of both the pinion 24 and the toothed gear 25 from the rollers 20 and 21.

The apparatus 1 according to the present invention therefore offers the advantages described above of the ring type support structure and is without the drawbacks previously mentioned since there is no sliding electrical contact. The pre-stretching unit 19, in fact, is powered by the alternator 29 which generates the necessary electrical energy during the rotation of the rotating ring 12. The alternator 29 only requires the connection of its pinion 30 and the outer ring 11 but this type of connection is not affected in the least by the ambient humidity and therefore the apparatus 1 can be used in highly humid atmospheres.

During the transient phases, or during the start-up phases of the rotating ring 12 and the beginning of the operating cycle for wrapping a group of products 2, the alternator 29 needs a certain energising current to operate and receives this current directly from the electric motor 22. The start-up of the rotating ring 12 while the electric motor 22 is not running and not powered, in fact, causes the band 6 to unwind from the reel 5 caused by the free end of the band 6 being held by the gripper and cutting means 33. The band 6 which unwinds turns the fast roller 21 and this starts up the electric motor 22 in the opposite direction of the unwinding of the reel 5. The electric motor 22, not receiving electrical power and instead having its shaft rotated, acts like an electrical generator and supplies electrical energy to the alternator 29. The energy that the alternator 29 receives produces an induction field sufficient to energise it, in the sense that it makes it function correctly as an electrical generator. The electric motor 22 is therefore a useful source of direct current which can produce the necessary induction field to energise the alternator 29. The alternator 29 then begins to generate electric energy and to transmit it to the electric motor 22 and to the electromagnetic clutch 32 that is then energised, or brought into a motion transmission configuration. The electric motor 22 begins to work and to correctly drive the pre-stretching unit 19. It is clear that, for the apparatus 1 an increase in the rotation speed of the rotating ring 12 brings an increase in the electric energy generated by the alternator 29 and, above all, brings an advantageous increase in the operating speed of the entire apparatus 1.

Moreover, the use of only two uprights 8 allows easier access to the operating area of the apparatus 1 to put the upper covers on the product groups 2 during their wrapping phase without interrupting it at all.

The invention thus conceived can be subject to several modifications and variations without thereby departing from the scope of the inventive concept. Moreover, all components may be replaced with technically equivalent parts.

What is claimed:

1. An apparatus for the wrapping of palletized product groups with a film or band of plastic including a support framework supporting a vertically mobile support structure for a mobile carriage which runs along said vertically mobile support structure, said carriage supporting a reel of plastic film, a pre-stretching unit, and an electric motor for driving said pre-stretching unit, said vertically mobile support structure comprising a vertically moving structure supported by said support framework and a rotating ring rotating around its own axis driven by a motor anchored and connected to said vertically moving structure; said carriage being fixed to the rotating ring and supporting an electric generator electrically connected to the electric motor of said pre-stretching unit for which it is the power supply source, said vertically moving structure including an annular toothed track and said electric generator including a shaft in continuous connection with said annular toothed track such that said shaft of said electric generator rotates in response to the rotation of said rotating ring.

2. The apparatus, according to claim 1, wherein the electric motor input of said pre-stretching unit is electrically connected to the output of said electrical generator and its output is connected to the energizing circuit of said electric generator to supply it with a suitable source for the necessary induction field.

3. The apparatus, according to claim 1, wherein said pre-stretching unit includes a first roller and a second roller driven by said electric motor with different rotation speeds, at least one of said first and second rollers being connected to said electric motor using at least one electro-magnetic clutch.

4. The apparatus, according to claim 3, wherein said clutch is electrically connected to said electric generator and can have a motion transmission configuration during the normal operating rotation of said rotating ring in which it is energized by said electric generator and both the rollers are connected to said electric motor and a no motion transmission configuration during the rotation starting phase of said rotating ring in which only the second roller remains connected to said electric motor.

5. The apparatus, according to claim 1, wherein said support framework comprises two vertical uprights each of which forms a support guide for a support carriage which mounts said vertically moving structure.

6. The apparatus, according to claim 5, wherein said vertically moving structure is ring-shaped.

7. An apparatus for wrapping palletized product groups, said apparatus comprising:

a support framework supporting a vertically mobile support structure, said vertically mobile support structure including:

a vertically moving structure supported by said support framework;

a rotating ring rotating around its own axis;

a motor drivingly connected to said rotating ring for rotating said rotating ring around its own axis;

a carriage connected to said rotating ring, said carriage supporting a plastic film pre-stretching unit and an electric motor drivingly connected to said pre-stretching unit; and, an electric generator electrically connected to said electric motor of said pre-stretching unit to supply electrical power to said pre-stretching unit, said generator driven upon rotation of said rotating ring to supply electrical power to said electric motor of said pre-stretching unit upon rotation of said rotating ring.

8. An apparatus as recited in claim 7, further comprising an annular toothed track connected to said vertically moving structure, said electric generator including an input shaft in continuous connection with said toothed track.

9. An apparatus as recited in claim 7, wherein said electric motor of said pre-stretching unit includes an output electrically connected to an energizing circuit of said generator to supply said generator with a suitable source for an induction field.

10. An apparatus as recited in claim 7, wherein said pre-stretching unit comprises:

a first roller and a second roller driven by said electric motor of said pre-stretching unit with different rotational speeds, at least one of said first and second rollers connected to said electric motor of said pre-stretching unit using at least one electromagnetic clutch.

11. An apparatus as recited in claim 10, wherein said at least one clutch is electrically connected to said electric generator and has a motion transmission configuration during the normal operating rotation of said rotating ring in which it is energized by said electric generator and in which both the rollers are connected to said electric motor, and a no motion transmission configuration during the rotation starting phase of said rotating ring in which only the second roller remains connected to said electric motor of said pre-stretching unit.

12. An apparatus as recited in claim 7, wherein said support framework comprises two vertical uprights each of which forms a support guide for a support carriage which mounts said vertically moving structure.

13. An apparatus as recited in claim 12, wherein said vertically moving structure is ring-shaped.

* * * * *

UNITED STATES PATENT AND TRADEMARK OFFICE

CERTIFICATE OF CORRECTION

PATENT NO. : 5,768,862

DATED : June 23, 1998

INVENTOR(S) : Mauro Cere

It is certified that error appears in the above-indentified patent and that said Letters Patent is hereby corrected as shown below:

On the title page, under item [19], delete "Mauro" and insert --Cere--

In the title page, Item [75], "delete Cere Mauro" and insert therefor: ---Mauro Ceré---.

Signed and Sealed this

First Day of September, 1998

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,768,862
DATED : June 23, 1998
INVENTOR(S) : Mauro Ceré

It is certified that error appears in the above-identified patent and that said Letters Patent is hereby corrected as shown below:

The title page should be deleted and substitute therefor the attached title page.

Column 3, line 4, after "on" insert --the same or--.

Signed and Sealed this

Sixteenth Day of March, 1999

*Attest:*

*Attesting Officer*

Q. TODD DICKINSON

*Acting Commissioner of Patents and Trademarks*

US005768862A

United States Patent [19]

Mauro

[11] Patent Number: 5,768,862

[45] Date of Patent: Jun. 23, 1998

[54] APPARATUS FOR THE WRAPPING OF PALLETIZED PRODUCT GROUPS WITH PLASTIC FILM

[75] Inventor: Ceré Mauro, Loiano (Bologna), Italy

[73] Assignee: Robopac Sistemi S.r.l., Rimini, Italy

[21] Appl. No.: 643,510

[22] Filed: May 6, 1996

[51] Int. Cl.[6] ..... B65B 53/00

[52] U.S. Cl. ..... 53/556; 53/588

[58] Field of Search ..... 53/588, 556, 210

[56] References Cited

U.S. PATENT DOCUMENTS

| | | | |
|---|---|---|---|
| 4,829,753 | 5/1989 | Bricmont | 53/588 |
| 4,905,448 | 3/1990 | Plitt | 53/588 X |
| 5,390,476 | 2/1995 | Moramtz | 53/588 X |

FOREIGN PATENT DOCUMENTS

| | | | |
|---|---|---|---|
| 34 33 442 | 12/1985 | Germany . | |
| 36 34 924 | 4/1988 | Germany . | |
| 42 34 604 | 4/1994 | Germany . | |
| 4234604 | 4/1994 | Germany | 53/588 |

*Primary Examiner*—Linda Johnson
*Attorney, Agent, or Firm*—Fay, Sharpe, Beall, Fagan, Minnich & McKee

[57] ABSTRACT

The apparatus for the wrapping of palletized product groups with a film or band of plastic includes a framework with two vertical support uprights on a support structure of a carriage supporting a reel of plastic film and a pre-stretching unit driven by an electric motor and envisages that the support structure consists of a vertically moving structure supported by the support framework and by a rotating ring supported by the vertically moving structure and rotating around its own axis driven by a motor anchored to the vertically moving structure and connected to it; the carriage is fixed to the rotating ring and supports an electric generator for powering the electric motor of the pre-stretching unit and maintained with its own shaft continuously linked to a respective annular toothed track fixed to the vertically moving structure.

13 Claims, 2 Drawing Sheets

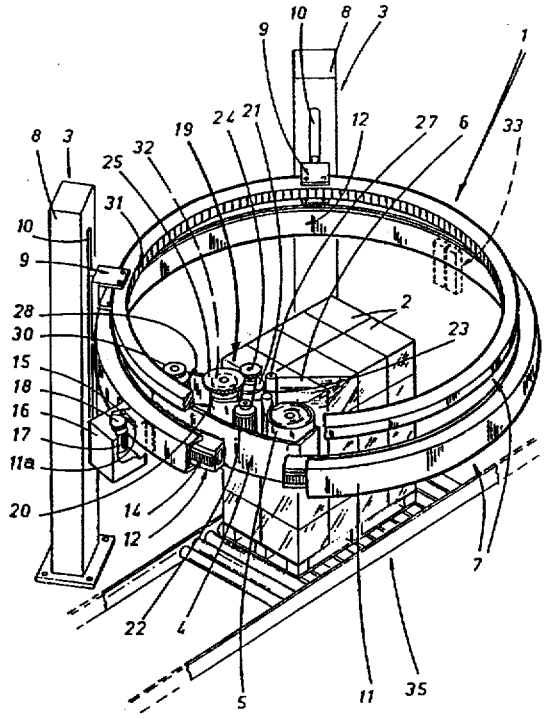

PTO/SB/ 44 (10-96)
Approved for use through 6/30/99. OMB 0651-0033
Patent and Trademark Office; U.S. DEPARTMENT OF COMMERCE
Under the Paperwork Reduction Act of 1995, no persons are required to respond to a collection of information unless it displays a valid OMB control number.

(Also Form PTO-1050)

UNITED STATES PATENT AND TRADEMARK OFFICE
CERTIFICATE OF CORRECTION

PATENT NO : 5,768,862

DATED : June 23, 1998

INVENTOR(S): Mauro Cere

It is certified that error appears in the above-identified patent and that said Letters Patent are hereby corrected as shown below:

Replace FIGURE 1 with the following:

FIG1

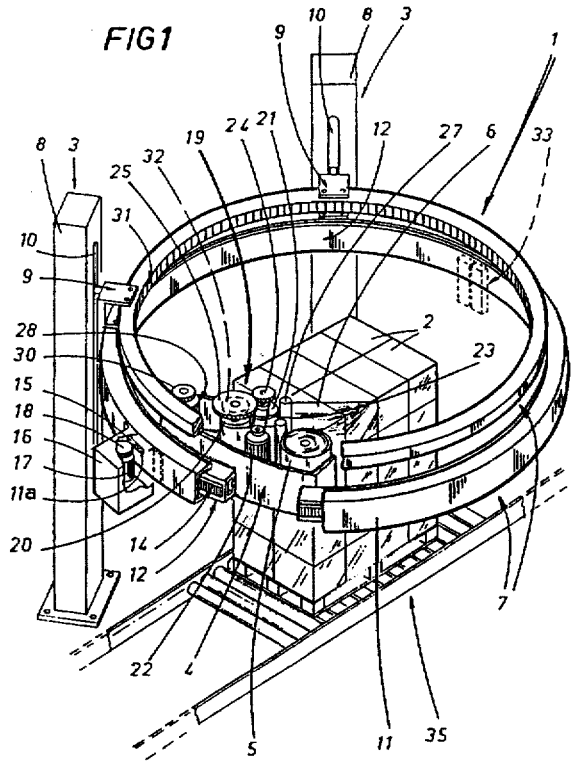

MAILING ADDRESS OF SENDER:
Richard J. Minnich
Reg. No. 24,175
FAY, SHARPE, BEALL, FAGAN, MINNICH & McKEE
1100 Superior Avenue, 7th Floor
Cleveland, Ohio 44114-2518
Phone: (216) 861-5582

PATENT NO. 5,768,862

No. of additional copies

Burden Hour Statement: This form is estimated to take 1.0 hour to complete. Time will vary depending upon the needs of the individual case. Any comments on the amount of time you are required to complete this form should be sent to the Chief Information Officer, Patent and Trademark Office, Washington, DC 20231. DO NOT SEND FEES OR COMPLETED FORMS TO THIS ADDRESS. SEND TO: Assistant Commissioner for Patents, Washington, DC 20231.